US006848189B2

(12) United States Patent
Moake et al.

(10) Patent No.: US 6,848,189 B2
(45) Date of Patent: Feb. 1, 2005

(54) METHOD AND APPARATUS FOR MEASURING A DISTANCE

(75) Inventors: Gordon L. Moake, Houston, TX (US); Paul David Ringgenberg, Frisco, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 10/464,096

(22) Filed: Jun. 18, 2003

(65) Prior Publication Data

US 2004/0255479 A1 Dec. 23, 2004

(51) Int. Cl.[7] ..... E21B 47/08; G01B 5/12
(52) U.S. Cl. ..... 33/544; 33/542
(58) Field of Search ..... 33/544, 542, 544.2, 33/544.3, 555.1

(56) References Cited

U.S. PATENT DOCUMENTS

| | | | | |
|---|---|---|---|---|
| 3,915,229 A | * | 10/1975 | Nicolas | 33/544.3 |
| 4,006,530 A | * | 2/1977 | Nicolas | 33/544.3 |
| 4,058,900 A | | 11/1977 | Yandell | |
| 4,247,985 A | | 2/1981 | Boyle | 33/544.3 |
| 4,251,921 A | * | 2/1981 | Fink | 33/544.3 |
| 4,302,881 A | | 12/1981 | Schwind et al. | 33/544.3 |
| 4,463,378 A | | 7/1984 | Rambow | |
| 4,480,186 A | | 10/1984 | Wolk | |
| 4,673,890 A | | 6/1987 | Copland et al. | 33/544 |
| 4,914,826 A | | 4/1990 | Nold, III | |
| 4,939,362 A | | 7/1990 | Supernaw et al. | |
| 4,982,383 A | | 1/1991 | Sims et al. | |
| 5,091,644 A | | 2/1992 | Minette | |
| 5,548,900 A | | 8/1996 | Hunt-Grubbe | 33/302 |
| 6,384,605 B1 | | 5/2002 | Li | |
| 6,647,637 B2 | * | 11/2003 | Lechen | 33/544 |

* cited by examiner

*Primary Examiner*—Christopher W. Fulton
(74) *Attorney, Agent, or Firm*—Conley Rose, P.C.

(57) ABSTRACT

A distance measurement device and method for measuring a distance between two reference points comprising a housing, a base, and a flexible member curving therebetween. The flexible member housing end is allowed to slide in a slide track in the housing. The housing also comprises sensors that detect the position of the flexible member housing end relative to the housing. The distance measurement device measures the distance between the two reference points by engaging the first reference point with the housing and engaging the second reference point with the flexible member apex. As the distance from the housing to the flexible member apex changes, the flexible member housing end slides in the housing slide track. There is a unique correlation between the location of the flexible member housing end and the distance to flexible member apex, and thus the second reference point. Using the information gathered by the sensors and the known dimensions of the housing, the distance measurement device thus measures the distance from the first reference point to the second reference point.

33 Claims, 6 Drawing Sheets

METHOD AND APPARATUS FOR MEASURING A DISTANCE

CROSS-REFERENCE TO RELATED APPLICATIONS

Not Applicable.

STATEMENT REGARDING FEDERALLY SPONSORED RESEARCH OR DEVELOPMENT

Not Applicable.

BACKGROUND OF THE INVENTION

1. Field of the Invention

The present invention relates to distance measuring devices.

2. Description of the Related Art

It is often necessary to measure a distance between two measurement points such as from a first surface to another surface. For example, in order to improve oil and gas drilling and production operations, it is necessary to gather as much information as possible on the properties of the underground earth formation as well as the environment in which drilling takes place. Such properties include characteristics of the earth formations traversed by a well borehole, in addition to data on the size and configuration of the borehole itself. Among the characteristics of the earth formation measured are the resistivity, the density, and the porosity of the formation. However, the processes often employed to measure these characteristics are subject to significant errors unless information on the borehole size and configuration is also taken into account in their determination. Knowledge of the borehole size is also useful to estimate the hole volume, which is then used to estimate the volume of cement needed for setting casing or when hole stability is of concern during drilling.

The collection of downhole information, also referred to as logging, is realized in different ways. A well tool, comprising transmitting and detecting devices for measuring various parameters, can be lowered into the borehole on the end of a tubing, cable, or wireline. Parameter data measured by the tool is sent up to the surface using a cable attached to a mobile processing center at the surface. With this type of wireline logging, it becomes possible to measure borehole and formation parameters as a function of depth, i.e., while the tool is being pulled uphole.

It is known in the art to measure the diameter, also known as the caliper, of a borehole to correct formation measurements that are sensitive to size or standoff. These corrections are necessary for accurate formation evaluation. One technique for measuring the caliper incorporates a mechanical apparatus with extending contact arms that are forced against the wall of the borehole. However, this technique has practical limitations because of the mechanical instability of the caliper arms.

Due to the unsuitability of mechanical calipers to drilling operations, indirect techniques of determining borehole calipers have been proposed. Conventional caliper measurement techniques include acoustic transducers that transmit ultrasonic signals to the borehole wall. However, the techniques proposed with acoustic calipers entail measurements employing standoff and travel time calculations, resulting in data of limited accuracy. Sound wave reflections in soft formations may also be too weak to be accurately detected, leading to loss of signals.

Measuring the diameter of a borehole is only one of an unlimited number of examples where distance needs to be measured. It is desirable to obtain a simplified method and system for accurately determining a distance. Still further, it is desired to implement a distance measurement technique that is capable of measuring a wide range of distances.

The present invention overcomes the deficiencies of the prior art.

SUMMARY OF THE EMBODIMENTS

One of the embodiments provides a distance measurement device for measuring a distance between two reference points. By frame of reference only, the distance measurement device will be described in an axial and radial coordinate system. The measuring device comprises a housing and a base located axially from the housing. The base is connected to the housing to prevent relative movement between the housing and the base. The base may also be integral with the housing. A flexible member curves between the housing and the base in the radial direction relative to the housing. A flexible member base end pivotally engages the base. A flexible member housing end pivotally engages the housing and also moves axially in a slide track within the housing. The housing also comprises sensors for detecting the position of the flexible member housing end relative to the housing.

The distance measurement device measures the distance "R" from the surface of the housing engaged with a first reference point to the flexible member curve apex in the radial direction, with the apex being axially offset from the housing. The measurement device has a default position where the flexible member apex extends to a maximum distance "R". Placing the housing contact surface against the first reference point and the flexible member apex against a second reference point with a radial distance less than the maximum distance "R" constrains the flexible member and adjusts the position of the flexible member apex. Changing the distance "R" and thus the radial position of the apex slides the flexible member housing end within the housing slide track. There is a unique correlation between the location of the flexible member housing end and the radial position of the flexible member apex. Using the information gathered by the sensors and the known dimensions and properties of the distance measurement device, the distance measurement device can thus measure the radial distance "R" from the contact surface of the housing to the flexible member apex, and thus the distance between the two reference points. Because the device has no moving parts other than the flexible member, it is very reliable, inexpensive, and easy to maintain. Alternatively, the base may be free to move axially relative to the housing.

In an alternative embodiment, a permanent magnet is attached to the flexible member housing end. The magnet produces a magnetic field that moves as the flexible member housing end slides in relation to a change in the radial distance "R". Sensors located inside the housing detect the magnetic field to determine the location of the magnet. With the location of the magnet relative to the housing known, the radial distance "R" between the housing and the flexible member apex may then be determined.

In another embodiment, the distance measurement device may comprise more than one flexible member azimuthally spaced at different radial angles around the housing. In this embodiment, the housing is located between at least two flexible members and two radial distances, "R" and "R2", are measured to determine the radial distances between the housing and the apexes of the flexible members.

In another embodiment, the distance measurement device is mounted on a downhole tool and placed within a wellbore.

The flexible member contacts the borehole wall to force the opposite side of the downhole tool against the opposite side of the borehole wall. Knowing the radial distance between the housing and the flexible member apex as well as the dimensions of the housing and downhole tool, the diameter of the borehole may be determined.

In another embodiment, there may be more than one distance measurement device mounted on the downhole tool. The flexible members contact the sides of the borehole wall. Knowing the radial distances between the housing and the flexible member apexes as well as the dimensions of the housing and downhole tool, the diameter of the borehole may be determined.

Thus, the embodiments comprise a combination of features and advantages that overcome the problems of prior art devices. The various characteristics described above, as well as other features, will be readily apparent to those skilled in the art upon reading the following detailed description of the embodiments, and by referring to the accompanying drawings.

BRIEF DESCRIPTION OF THE DRAWINGS

For a more detailed description of the embodiments, reference will now be made to the following accompanying drawings.

DETAILED DESCRIPTION OF THE EMBODIMENTS

The present invention relates to a distance measurement device and includes embodiments of different forms. The drawings and the description below disclose specific embodiments of the present invention with the understanding that the embodiments are to be considered an exemplification of the principles of the invention, and are not intended to limit the invention to that illustrated and described. Further, it is to be fully recognized that the different teachings of the embodiments discussed below may be employed separately or in any suitable combination to produce desired results.

Figure 1:
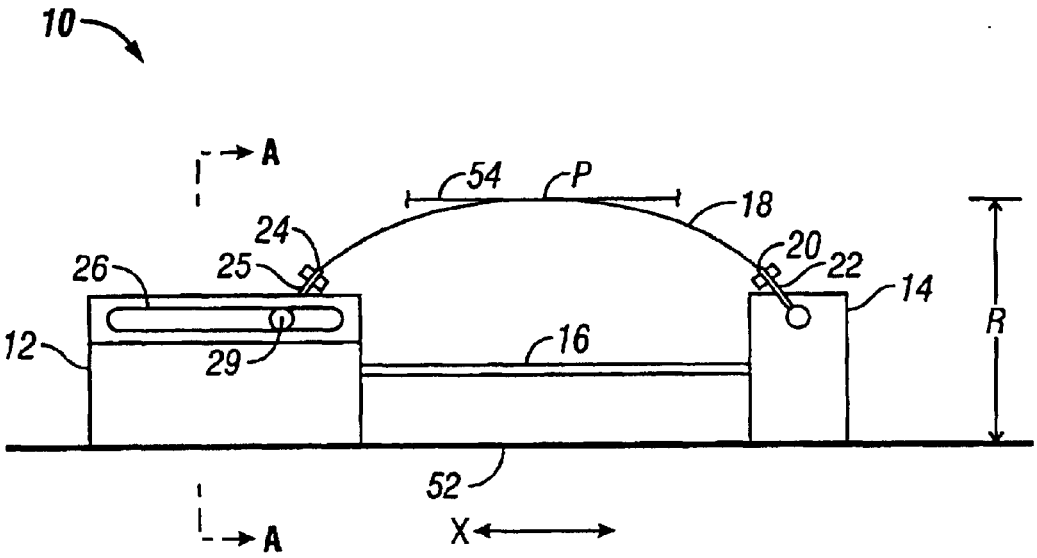
FIG. 1 is a side elevational view of a distance measurement device.
Figure 1A:
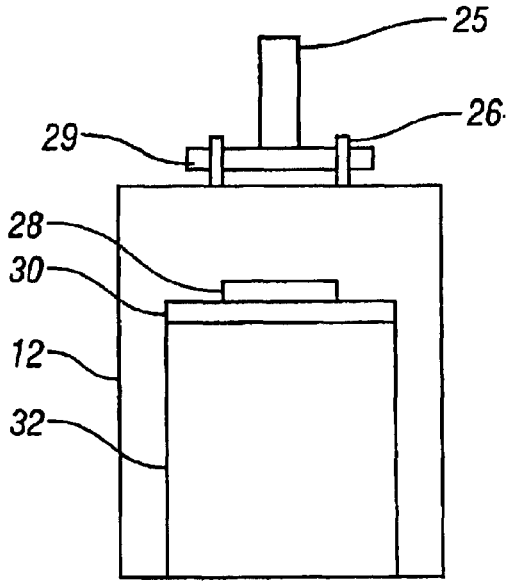
FIG. 1A is a front view from the plane A—A of the housing of the distance measurement device.

FIGS. 1 and 1A show a distance measurement device 10 for measuring a radial distance "R". The distance measurement device 10 comprises a housing 12 and a base 14. By frame of reference only, the distance measurement device 10 will be described in an axial and radial coordinate system with respect to the axis "X" shown in FIG. 1. The base 14 is located axially from the housing 12. However, the base 14 need not necessarily be located directly axially from the housing 12. The base 14 is connected to the housing by a fixed-length connector 16 to prevent relative movement between the housing 12 and the base 14. However, any suitable means may be used to connect the housing 12 and the base 14. In addition, the housing 12 and the base 14 may also be one integral unit. Extending between the housing 12 and the base 14 and curving in the radial direction is a flexible member 18. As an example only, the flexible member may be a bowspring. The flexible member base end 20 comprises a bracket 22 that pivotally attaches to the base 14. The flexible member housing end 24 comprises a bracket 25 that slides in a slide track 26 in the housing 12 as well as rotates relative to the housing 12. As shown in FIG. 1A, the bracket 25 comprises a pivot pin 29 that engages the slide track 26 and allows the bracket 25 to pivot and slide within the slide track 26. Brackets 22, 25 each comprise a yoke with a pin for attachment to the ends 24, 20 of the flexible member 18. The housing 12 also comprises sensors 28 disposed along the slide track 26 that detect the position of the flexible member housing end 24 relative to the housing 12. The sensors 28 are located on a circuit board 30 located on a chassis 32 adjacent to the slide track 26. The housing 12 may also comprise information storage and/or processing equipment, not shown. Alternatively, the information from the sensors 28 may be stored and processed in a component other than the distance measurement device 10. In addition, the sensors 28 may be mounted by any suitable means and in any suitable location on or in the housing 12 to determine the location of the flexible member housing end 24.

The distance measurement device 10 measures the distance "R" in radial direction from the housing 12 to the apex "P" of the curve of the flexible member 18. The distance "R" is offset axially because the apex "P" is axially offset from the housing 12. When not engaged with an reference point, the flexible member 18 is in a default position where the apex "P" is at the maximum possible distance "R" from the housing. The distance measurement device 10 is calibrated with the known dimensions of the default position. The distance measurement device 10 may also be calibrated without knowing the default position where the apex "P" is at the maximum possible distance "R" from the housing. For example, a measurement of a known reference distance may be used to determine the measurement given by the distance measurement device 10 requires calibration.

To measure a distance, the distance measurement device 10 is placed with the housing 12 against a first reference point or surface 52. The flexible member 18 is then placed between the first reference point 52 and a second reference point or surface 54. Engaging the second reference point or surface 54 adjusts the radial distance "R" of the apex "P" relative to the housing 12 and slides the flexible member housing end 24 in the slide track 26. There is a unique correlation between the location of the flexible member housing end 24 and the distance "R". The sensors 28 detect the position of the flexible member housing end 24 relative to the housing 12. Using the information gathered by the sensors 28 and the known dimensions and properties of the distance measurement device 10, the distance measurement device 10 measures the distance "R" from the housing 12 to the apex "P". By way of example only, the distance measurement device 10 may be used to measure the diameter of an oil and gas well borehole. In the borehole, the housing 12 and base 14 are biased against one side of the borehole wall 52 by the force of the flexible member 18 being compressed against another side of the borehole wall 54. Because the distance measurement device 10 has no moving parts other than the flexible member 18, it is very reliable, inexpensive, and easy to maintain.

Alternatively, the base 14 may be free to move relative to the housing 12. If free to move, the base 14 also comprises sensors for measuring the position of the flexible member base end 20. The distance measurement device 10 must also then take the additional movement of the base 14 into consideration in calculating the radial distance "R". In addition, the housing 12 and the base 14 may alternatively be an integral unit.

Figure 2:
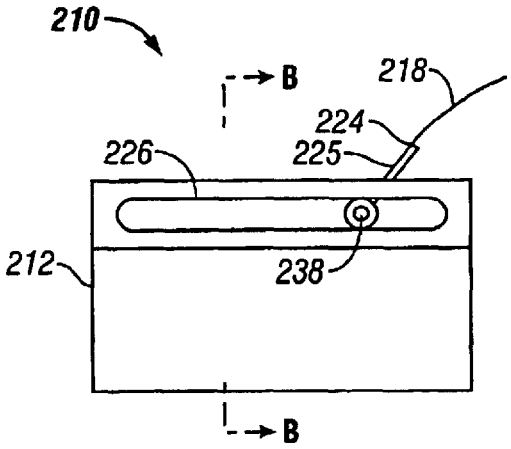
FIG. 2 is a partial side elevational view of another embodiment of the distance measurement device.
Figure 2A:
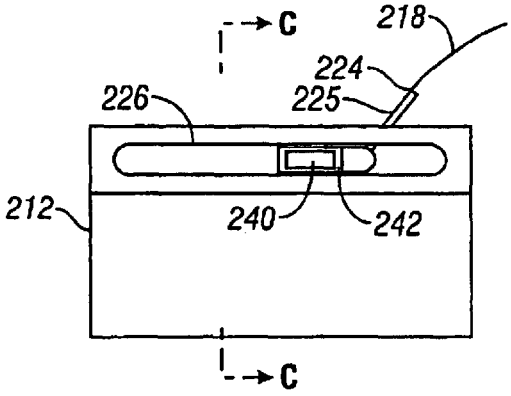
FIG. 2A is a partial side elevational view of another embodiment of the distance measurement device.
Figure 2B:
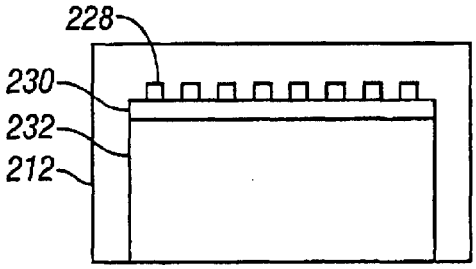
FIG. 2B is a sectional side view of the embodiments of the distance measurement devices shown in FIGS. 2 and 2A.
Figure 2C:
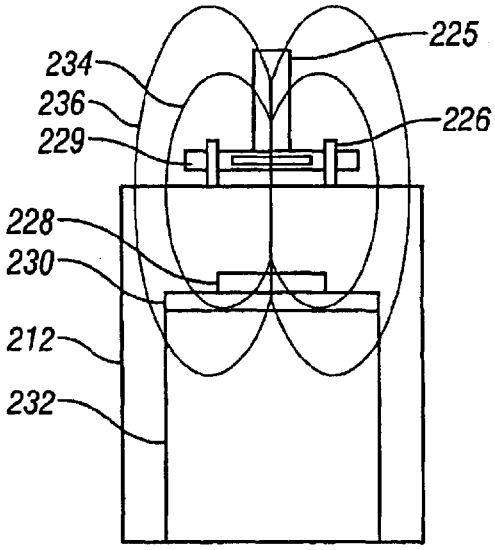
FIG. 2C is a front sectional view from planes B—B and C—C of the embodiments of the distance measurement devices shown in FIGS. 2 and 2A.

FIGS. 2 and 2A–2C show another embodiment 210 of the distance measurement device. For simplicity, FIGS. 2 and 2A–2C only show the housing 212 portion of the distance measurement device 210. The remainder of the distance measurement device 210 is similar to the distance measurement device 10 described above. With the measurement device 210, however, the flexible member housing end 224 comprises a permanent magnet 238 included in the bracket 225 with the North-South field oriented radially. The magnet 238 produces a magnetic field inside the housing 212 indicated by flux lines 234, 236 shown in FIG. 2C. The magnetic field moves as the flexible member housing end 224 moves within the housing slide track 226, thus indicating a change in the distance "R". An array of sensors 228 located inside the housing 212 detect the magnetic field of the magnet 238. By way of example only, the sensors 228 may be Hall-effect sensors. However, any suitable sensors for detecting the magnetic field may be used. The sensors 228 detect the magnetic field to determine the location of the magnet 238 relative to the housing 212. As the flexible member housing end 218 moves, the bracket 225 will also rotate relative to the housing 212. As such, the magnetic field will also rotate. The distance measurement device 210 is calibrated for such rotation so as to not distort the detection of the position of the flexible member housing end 224. Alternatively, as shown in FIG. 2A, the bracket 225 may also comprise a magnet housing 242 that houses a magnet 240. By way of example, the sensors 228 sense the magnetic field of the magnet 238. The centroid method may then be used to determine the position of the magnet 238. The centroid method determines the position by multiplying the signal from each sensor 228 by the position of that sensor 228, with the resultant products from all the sensors 228 added together. The sum is then divided by the sum of all the signals, with the quotient being the measured position of the magnet 238. Other measurement techniques may also be used to determine the position of the magnet 238 from the measurements of the sensors 228.

Figure 3:
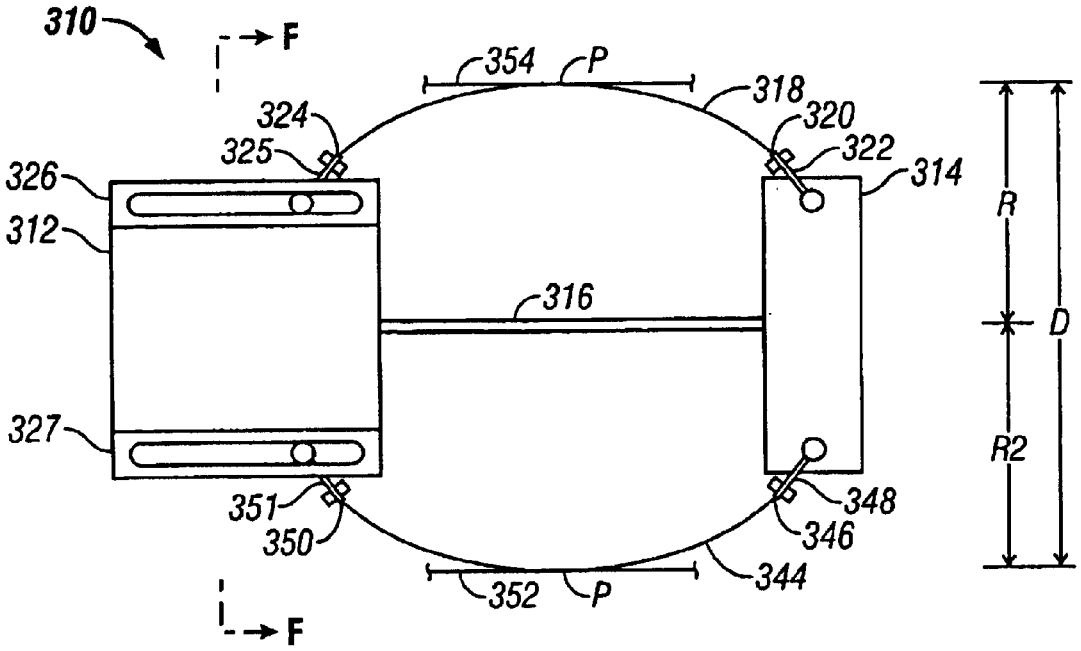
FIG. 3 is a side elevational view of another embodiment of the distance measurement device.
Figure 3A:
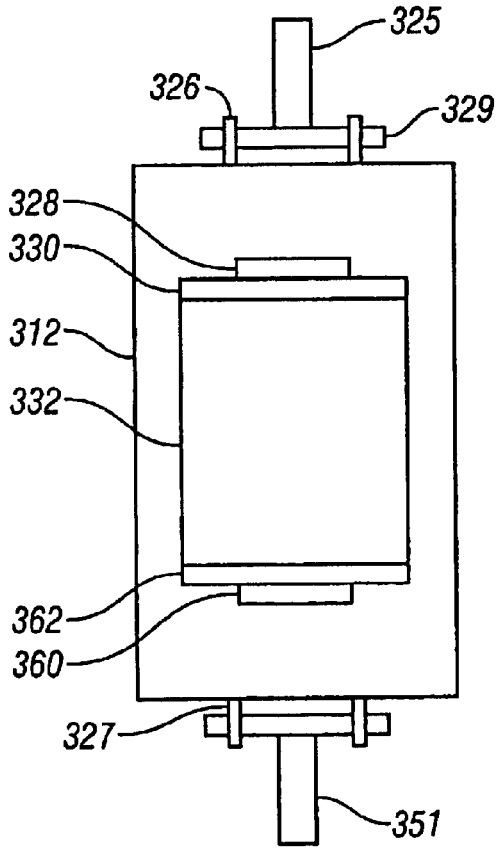
FIG. 3A is a front view of the plane F—F of the distance measurement device of FIG. 3.

FIGS. 3 and 3A show another embodiment 310 of the distance measurement device. The distance measurement device 310 comprises a housing 312, a base 314, and a first flexible member 318 and operates in a similar manner to the distance measurement device 10. In addition to the first flexible member 318, the distance measurement device 310 also comprises a second flexible member 344 opposite the first flexible member 318. The second flexible member 344 is similar to flexible member 318, comprising a housing end 350 with bracket 351 and a base end 346 with bracket 348. The flexible member housing end 350 slides in a second slide track 327. The distance measurement device 310 may also comprise more than two flexible members, such as three or four flexible members, with the flexible members being azimuthally spaced around the housing 312. Thus, instead of measuring one radial distance "R", the distance measurement device 310 also measures at least one additional distance "R2" to determine the total distance "D" between the apexes of the flexible members 318 and 344 and between the reference points or surfaces 352, 354. For example, in a borehole, reference numbers 352, 354 are the opposing walls of the borehole. The housing 312 comprises sensors (not shown) for each flexible member.

In operation, the measurement device 310 performs similarly to the measurement devices 10 or 210. As shown in FIG. 3A, the measurement device 310, however, additionally comprises sensors 360 mounted on a circuit board 362 mounted on the chassis 332. The sensors 360 detect the position of the flexible member housing end 351 relative to the housing 312. Thus, using the information gathered by the sensors 328 and 360 and the known dimensions and properties of the housing 312 and the flexible members 318 and 344, the distance measurement device 310 can measure the distance "D" between the apexes "P" and thus the first and second reference points 352, 354.

Figure 4:
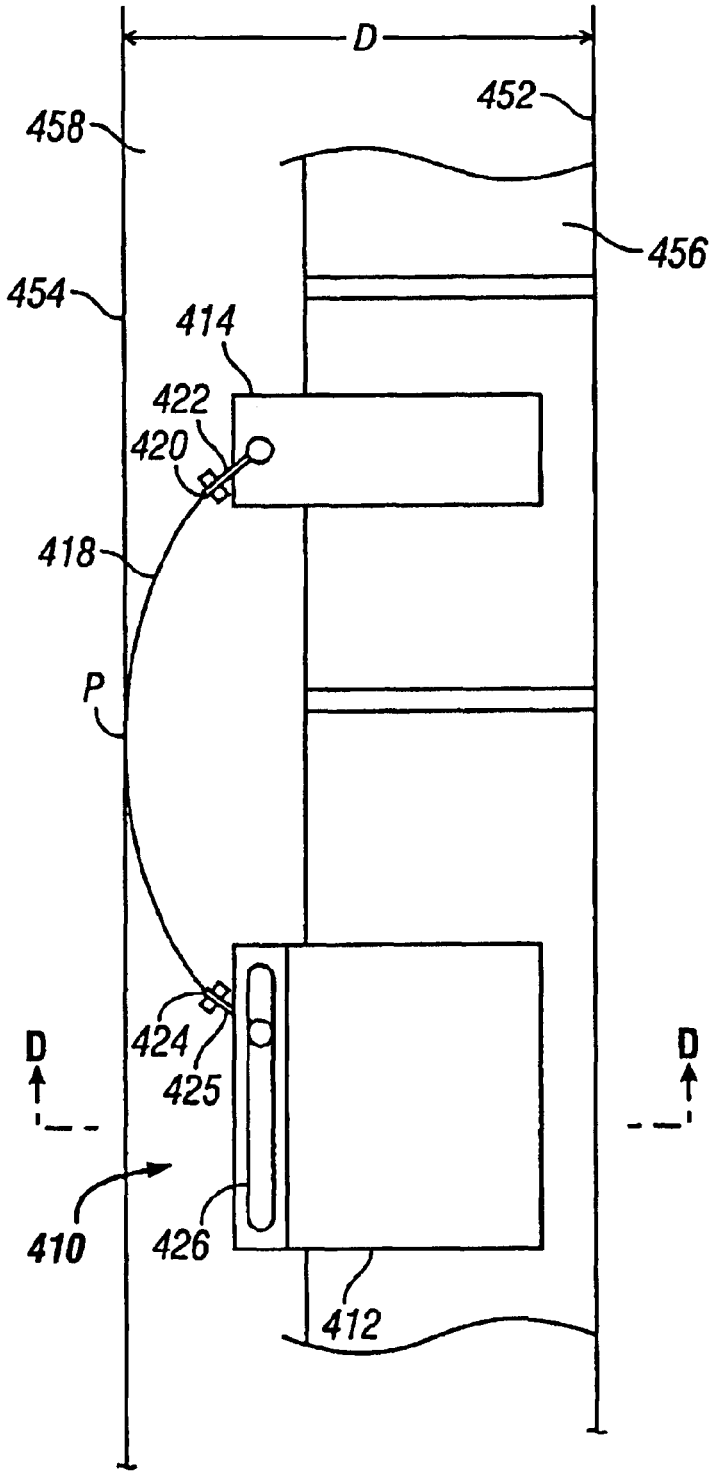
FIG. 4 is a side elevational view of another embodiment of the distance measurement device.
Figure 4A:
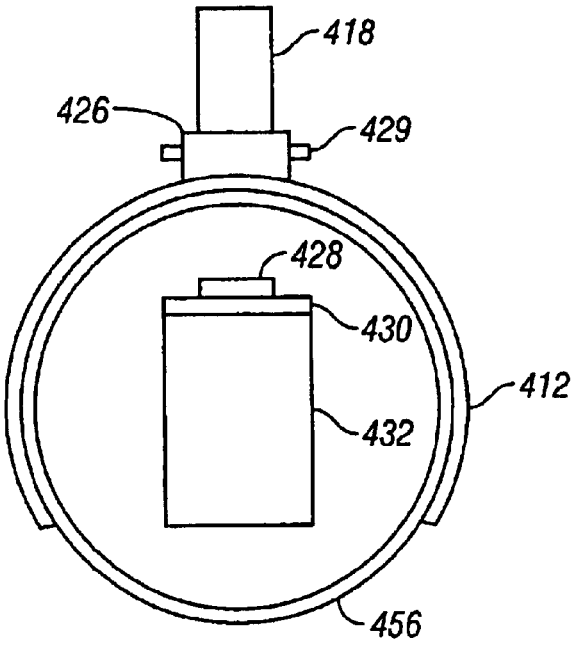
FIG. 4A is front view of the plane D—D of the distance measurement device of FIG. 4.

FIGS. 4 and 4A show another alternative embodiment 410 of the distance measurement device installed on a downhole tool 456, such as a downhole logging tool, and placed in a borehole 458. The distance measurement device 410 measures the diameter "D" of the borehole 458. The housing 412 and the base 414 may be integrated with or attached onto the downhole tool 456. When attached to the downhole tool 456 and placed downhole in the borehole 458, the flexible member 418 engages the side of the borehole wall 454. Additionally, opposite the flexible member 418, the downhole tool 456 engages the opposite side of the borehole wall 452. The flexible member 418 biases the opposite side of the downhole tool 456 against the side 452 of the borehole wall. The housing 412 and the base 414 are configured for attachment onto the downhole tool 456. Although, as shown in FIG. 4A, the housing 412 and the base 414 are generally "arc-shaped", the housing 412 and the base 414 may be any configuration such that the housing 412 and the base 414 will attach to the downhole tool 456. The base 414 may also be integral with the housing 412 to form one unit. In the measurement device 410, the sensors 428 are mounted on a circuit board 430 on a chassis 432 inside the downhole tool 456. The sensors 428 are such that they may detect the position of the flexible member housing end 425 in the slide track 426 through the wall of the downhole tool 456. For example, the measurement device 410 may operate with magnets similar to measurement device 210.

The distance measurement device 410 uses the information gathered by the sensors 428 and the known dimensions and properties of the distance measurement device 410 and the downhole too 456, the distance measurement device 410 can measure the diameter "D" of the borehole 458. If the curvature of the borehole wall 452 is severe, the sides of either the flexible member 418 or the tool 456 can prevent the measurement device 410 from accurately measuring the diameter "D" of the borehole 458. This is because the width of the flexible member 418 or the tool 456 would not engage the true points of reference 452, 454 of the borehole wall representative of the borehole 458 diameter "D". The known dimensions of the distance measurement device 410 and the downhole tool 456 would therefore be used to calibrate the measurement device 410 for error if the curvature the borehole wall were significant in relation to the width of the flexible member 418 or the downhole tool 456.

The distance measurement device 410 can also determine the diameter "D" of the borehole 458 as the distance measurement device 410 travels through the borehole 458. Each diameter measurement will correspond to a unique position of the flexible member housing end 424. The measurement can then be used with the known dimensions of the tool 456 to determine the diameter "D" of the borehole 458. The mapping of the position to diameter can be well approximated by a quadratic equation, although it should be appreciated that higher orders could be used. Thus, if the diameter of the borehole is represented by a D, the diameter D can be computed from measurements where x is the measurement for "R", plus the known dimension of the measurement device 410, and plus the known dimensions of the tool 456, using the equation $D=a_o+a\alpha+a\alpha^2$, where $a_o$, $a_1$, and $a_2$ are constants determined by calibration of the measurement device 410.

Figure 5A:
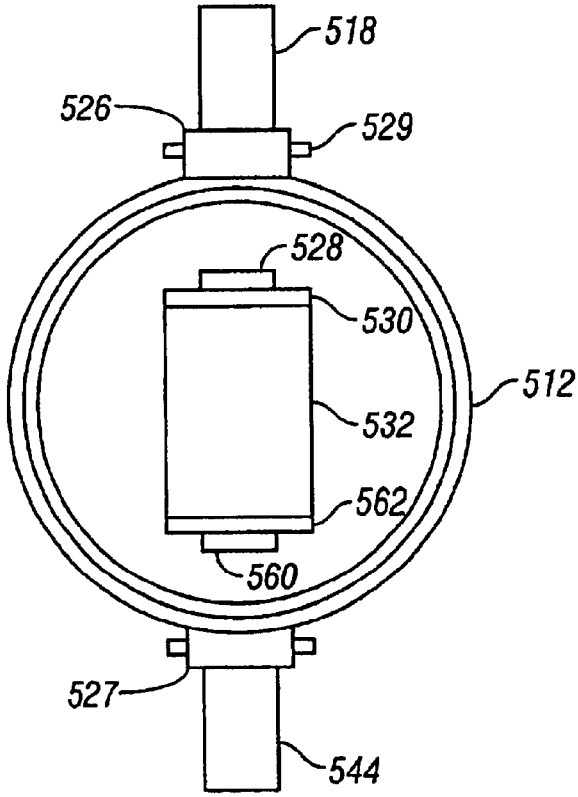
FIG. 5A is a front view of the plane E—E of the distance measurement device of FIG. 5.
Figure 5:
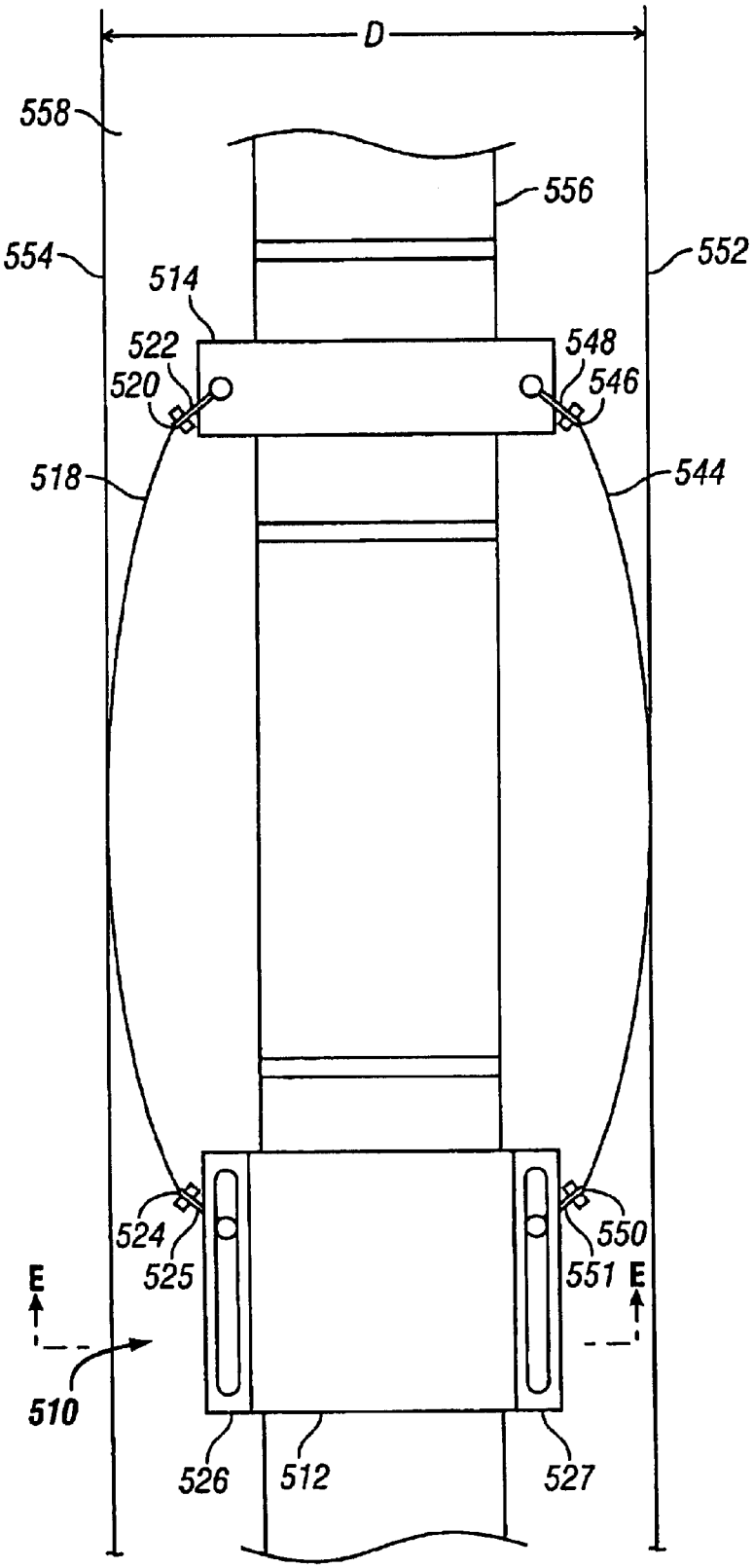
FIG. 5 is a side elevational view of another embodiment of the distance measurement device.

FIGS. 5 and 5A show another alternative embodiment distance measurement device 510. As shown in FIGS. 5 and 5A, the distance measurement device 510 is mounted to the downhole tool 556. The distance measurement device 510 comprises a housing 512, a base 514, a flexible member 518, and a second flexible member 544 and operates in a similar manner to the distance measurement device 410. There may also be more than two flexible members with the flexible members being azimuthally spaced around the downhole tool 556. The housing 512 and the base 514 may also be integrated with or attached onto the downhole tool 556.

The distance measurement device 510 measures the diameter "D" of the borehole 558. When attached to the downhole tool 556 and placed downhole in the borehole 558, the flexible members 518, 544 engage opposite sides of the borehole wall 554, 552. The force of the flexible members 518, 544 bias the downhole tool 456 towards, but not necessarily in, the center portion of the borehole 558. The housing 512 and the base 514 are configured for attachment onto the downhole tool 556. Although, as shown in FIG. 5A, the housing 512 and the base 514 are generally circular in shape, the housing 512 and the base 514 may be any configuration such that the housing 512 and the base 514 will attach to the downhole tool 556. The base 514 may also be integral with the housing 512 to form one unit. The sensors 528 for the flexible member 518 are mounted on a circuit board 530 on a chassis 532 inside the downhole tool 556. In addition, sensors 560 are mounted on a circuit board 562 on the chassis 532 inside the downhole tool 556. The sensors 528 are such that they may detect the position of the flexible member housing end 525 in the slide track 526 through the wall of the downhole tool 556. The sensors 560 are such that they may detect the position of the flexible member housing end 550 in the slide track 527 through the wall of the downhole tool 556. For example, the measurement device 510 may operate with magnets similar to measurement device 210. Using the information gathered by the sensors 528, 560 and the know dimensions and properties of the distance measurement device 510, the distance measurement device 510 can thus measure the diameter "D" of the borehole 558. the diameter "D" of the borehole 458 between the reference points or surfaces 552, 554. Centralizers may also be used in conjunction with the flexible members 518, 544 to centralize the downhole tool 556 in the borehole 558.

While specific embodiments have been shown and described, modifications can be made by one skilled in the art without departing from the spirit or teaching of this invention. The embodiments as described are exemplary only and are not limiting. Many variations and modifications are possible and are within the scope of the invention. Accordingly, the scope of protection is not limited to the embodiments described, but is only limited by the claims that follow, the scope of which shall include all equivalents of the subject matter of the claims.

What is claimed is:

1. A distance measurement device for measuring the distance between first and second reference points comprising:

a housing defining the first reference point;

a flexible member comprising a housing end engaging and capable of moving axially relative to the housing and a base end engaging a base, the flexible member curving radially relative to the housing between the housing and base ends with an apex; and sensors for detecting the axial position of the housing end relative to the housing, the position relating to the adjustable radial position of the flexible member apex defined by the second reference point.

2. The distance measurement device of claim 1 wherein the base is integral with the housing.

3. The distance measurement device of claim 1 wherein the base comprises sensors for detecting the rotational position of the flexible member base end relative to the base.

4. The distance measurement device of claim 1 wherein:

the flexible member housing end comprises a magnet; and the sensors detect the position of the flexible member housing end relative to the housing by detecting the magnetic field of the magnet.

5. The distance measurement device of claim 4 wherein the magnet is directly attached to the flexible member housing end.

6. The distance measurement device of claim 4 wherein the sensors are Hall-effect sensors.

7. The distance measurement device of claim 1 wherein the housing further comprises a slide track allowing the flexible member housing end to move axially relative to the housing.

8. The distance measurement device of claim 7 wherein the sensors are mounted in the slide track.

9. The distance measurement device of claim 1 wherein the sensors are mounted within the housing.

10. The distance measurement device of claim 1 comprising more than one flexible member for measuring the radial distances between the housing and the flexible member apexes.

11. The distance measurement device of claim 1 wherein the distance measurement device is mounted on a downhole tool and used to measure the diameter of the borehole.

12. The distance measurement device of claim 11 wherein the downhole tool is a density tool.

13. The distance measurement device of claim 11 wherein the downhole tool is a neutron-porosity tool.

14. A distance measurement device for measuring the distance between first and second reference points comprising:

a housing defining the first reference point;

a flexible member comprising a housing end pivotally engaging and capable of moving axially relative to the housing and comprising a base end pivotally engaging a base, the flexible member curving radially relative to the housing between the housing and base ends with an apex;

the housing end comprising a magnet with a magnetic field; and sensors for detecting the axial position of the housing end relative to the housing by detecting the magnetic field, the position relating to the adjustable radial position of the flexible member apex defined by the second reference point.

15. The distance measurement device of claim 14 wherein the base is integral with the housing.

16. The distance measurement device of claim 14 wherein the base comprises sensors for detecting the rotational position of the flexible member base end relative to the base.

17. The distance measurement device of claim 14 wherein the magnet is directly attached to the flexible member housing end.

18. The distance measurement device of claim 14 wherein the sensors are Hall-effect sensors.

19. The distance measurement device of claim 14 wherein the housing further comprises a slide track allowing the flexible member housing end to move axially relative to the housing.

20. The distance measurement device of claim 19 wherein the sensors are mounted in the slide track.

21. The distance measurement device of claim 14 wherein the sensors are mounted within the housing.

22. The distance measurement device of claim 14 comprising more than one flexible member for measuring the radial distances between the housing and the flexible member apexes.

23. The distance measurement device of claim 14 wherein the distance measurement device is mounted on a downhole tool and used to measure the diameter of the borehole.

24. The distance measurement device of claim 23 wherein the downhole tool is a density tool.

25. The distance measurement device of claim 23 wherein the downhole tool is a neutron-porosity tool.

26. A method of measuring a distance between first and second reference points comprising:

engaging the first reference point with a housing;

engaging the second reference point with an apex of a flexible member curving between the housing and a base such that a housing end of the flexible member engaging the housing moves axially relative to the housing in relation to the radial position of the flexible member apex;

detecting at least the axial position of the flexible member housing end relative to the housing with sensors in the housing; and determining the radial distance between the first and second reference points using the position of the flexible member housing end and the known housing dimensions.

27. The method of claim 26 wherein the flexible member housing end comprises a magnet, and further comprising sensing the position of the flexible member housing end relative to the housing by detecting the magnetic field of the magnet.

28. The method of claim 26 wherein the housing and base are one integral unit.

29. A method of measuring a diameter of a borehole comprising:

engaging a wall of the borehole with a downhole tool;

engaging the opposite side of the borehole wall with an apex of a flexible member curving between a housing and a base mounted on the downhole tool such that a housing end of the flexible member engaging the housing to moves axially relative to the housing in relation to the radial position of the flexible member apex;

detecting at least the axial position of the flexible member housing end relative to the housing with sensors in the housing;

determining the radial distance between the housing and the borehole wall using the position of the flexible member housing end and the known housing dimensions; and determining the diameter of the borehole using the radial distance between the housing and the borehole wall and the known dimensions of the downhole tool.

30. The method of claim 29 wherein the housing and the base are one integral unit.

31. A method of measuring a diameter of a well borehole comprising:

engaging the wall of the borehole with apexes of flexible members curving between corresponding housings and bases mounted on a downhole tool such that housing ends of the flexible members engaging the corresponding housings move axially relative to the corresponding housings in relation to the radial position of the apexes of the flexible members;

sensing at least the axial positions of the flexible member housing ends relative to the corresponding housings with sensors in the housings;

determining the radial distances between the housings and the borehole wall using the positions of the corresponding flexible member housing ends and the known dimensions of the housings; and determining the diameter of the borehole using the radial distances between the housings and the borehole wall and the known dimensions of the downhole tool.

32. The method of claim 31 wherein the housing and the base are one integral unit.

33. An apparatus for measuring a distance between first and second objects comprising:

a position detector adapted for positioning against the first object;

a flexible member having a first end fixed with respect to the position detector and a second end movably disposed on the position detector;

the flexible member adapted for engagement with the second object thereby constraining the curve of the flexible member and positioning the second end on the position detector; and the position detector measuring the distance between the first and second objects by detecting the position of the second end on the position detector.

* * * * *